United States Patent [19]

Henriquez

[11] Patent Number: 4,982,386

[45] Date of Patent: Jan. 1, 1991

[54] UNDERWATER ACOUSTIC WAVEGUIDE TRANSDUCER FOR DEEP OCEAN DEPTHS

[75] Inventor: Theodore A. Henriquez, Orlando, Fla.

[73] Assignee: The United States of America as represented by the Secretary of the Navy, Washington, D.C.

[21] Appl. No.: 532,251

[22] Filed: May 31, 1990

[51] Int. Cl.[5] ..... H04R 17/00

[52] U.S. Cl. ..... 367/151; 367/152; 367/165; 367/157; 310/337

[58] Field of Search ..... 367/152, 157, 162, 165, 367/173, 176, 159, 151; 310/337

[56] References Cited

U.S. PATENT DOCUMENTS

| | | | |
|---|---|---|---|
| 3,748,637 | 7/1973 | Larson et al. | 367/151 |
| 3,755,698 | 8/1973 | Trott | 367/151 |
| 4,101,865 | 7/1978 | Schurr | 367/152 |
| 4,297,607 | 10/1981 | Lynnworth et al. | 310/337 |
| 4,488,271 | 12/1984 | Held et al. | 367/151 |

*Primary Examiner*—Charles T. Jordan
*Assistant Examiner*—J. Woodrow Eldred
*Attorney, Agent, or Firm*—Thomas E. McDonnell; George Jameson

[57] ABSTRACT

A deep submergence, acoustically stable directional transducer uses a waveguide and an encapsulant to channel sound. The waveguide forms an air space with a housing so that radiated sound is totally reflected at the air space interface. The encapsulant is matched to the acoustic impedance of the sea water at the intended operating depth to minimize reflection at the encapsulant-to-sea water interface.

17 Claims, 1 Drawing Sheet

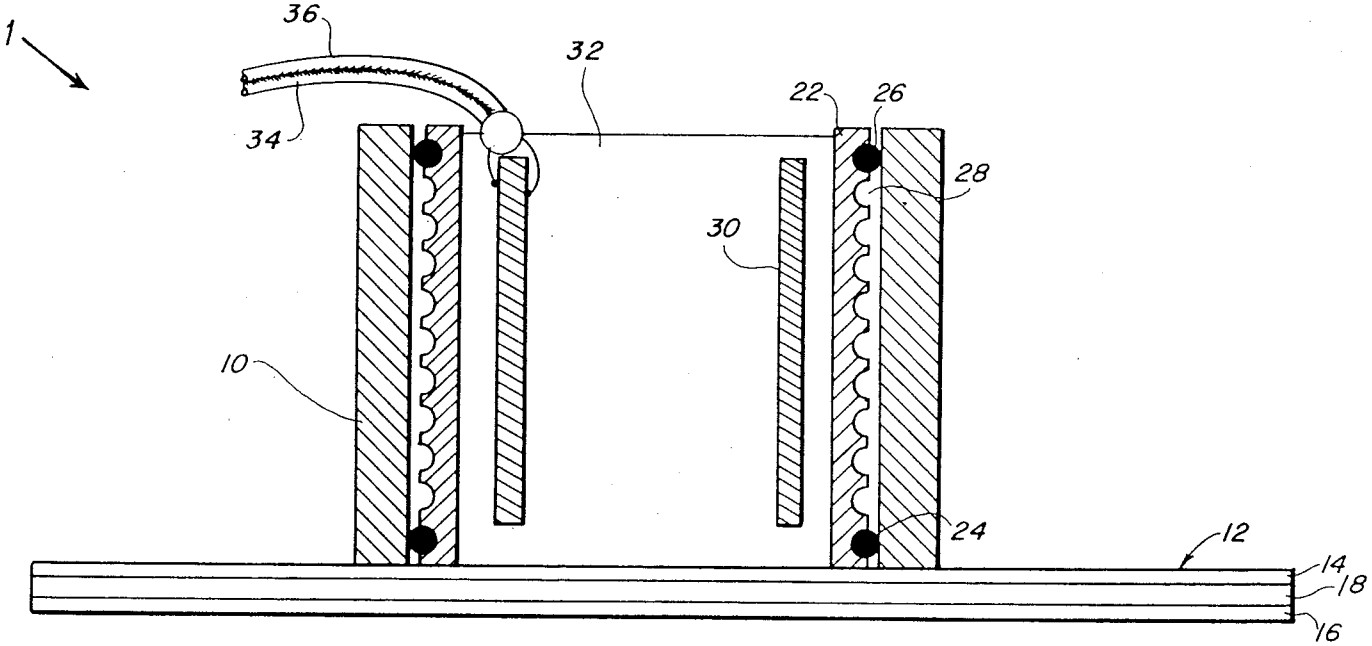
FIGURE

UNDERWATER ACOUSTIC WAVEGUIDE TRANSDUCER FOR DEEP OCEAN DEPTHS

FIELD OF THE INVENTION

The present invention relates generally to acoustic transducers. More specifically, the present invention relates to directional acoustic transducers for deep submergence underwater operation.

BACKGROUND OF THE INVENTION

Transducers for underwater sound applications perform the functions of generating sound waves in the medium or detecting the existence of sound waves in the medium. Directional transducers are designed to project sound waves in a relatively narrow beam pattern and to receive sound waves generated by a source within the beam pattern while rejecting noise.

It is known to use piezoelectric ceramic tubes in fabricating various underwater acoustic transducer systems to provide rugged and relatively efficient transducers. For example, U.S. Pat. Nos. 2,733,423 and 4,823,041 disclose the use of piezoelectric ceramic tubes for both directional and omnidirectional applications, respectively. The 2,733,423 patent discloses the use a piezoelectric ceramic tube located in a case and insulated, on its bottom and sides, from the case by a sound insulating material. In this type of transducer, the directivity is produced by the insulating material, which damps the outer radial vibrations but does not interfere with the interior vibrations. The piezoelectric ceramic tube interior and the bore of the transducer are filled with a fluid having the same acoustic characteristic as water, which permits transmission of generated sounds in the forward direction only.

It is also known to use baffles in constructing efficient directional transducers. U.S. Pat. Nos. 4,004,266 and 3,922,572 disclose the use of steel or stainless steel plates as baffles. The heavy steel plate disclosed in the 4,004,266 patent, for example, prevents cross talk between closely spaced transducers in an array.

Piezoelectric ceramic tubes are also known for use in deep submergence transducers requiring operation at depths exceeding 10,000 feet. For example, U.S. Pat. No. 3,372,370 discloses a transducer which uses a pressure-accommodating mass of epoxy resin and microspheres to compensate for hydrodynamic loading and to absorb acoustic energy within the transducer. The microspheres make the resin incompressible and prevent high pressures from distorting the resin, which in turn would distort the transducer output.

Heretofore, a deep submergence, acoustically stable directional transducer has not been produced using acoustically tuned polyurethane or a waveguide adjacent to an air space.

SUMMARY OF THE INVENTION

An object of the invention is to provide an improved directional transducer with high front-to-back rejection characteristics.

Another object of the present invention is to provide an improved directional transducer which maximizes reflection of sound.

It is a further object of the present invention to provide an improved transducer for acoustically stable operation at deep submergence depths.

These and other objects and advantages are achieved in accordance with the present invention by an underwater acoustic waveguide transducer having a baffle comprising first and second plates sandwiching a third plate wherein the first, second and third plates are hermetically sealed at their respective edges. The transducer further comprises an housing disposed perpendicular to and connected at a first end to the baffle, a cylindrical waveguide disposed within the housing, first and second seals for creating a closed air space between the outer housing and the waveguide, and a radially vibratable piezoelectric ceramic tube disposed within the waveguide. The piezoelectric ceramic tube is supported and isolated from the baffle and the waveguide by an polyurethane encapsulant acoustically matched to sea water at the operating depth of the apparatus.

These and other objects, features and advantages of the invention are disclosed in or apparent from the following description of preferred embodiments.

BRIEF DESCRIPTION OF THE DRAWINGS

The preferred embodiment is described with reference to the drawing FIGURE in which:

The FIGURE is a longitudinal sectional view of the preferred embodiment of a transducer according to the present invention.

DESCRIPTION OF THE PREFERRED EMBODIMENTS

Referring to the FIGURE, a transducer 1 according to the present invention comprises a cylindrical outer housing 10 attached to a plate-like reflecting baffle 12. Baffle 12 is formed from two thin plates 14, 16 positioned parallel to each other and separated by an intermediate third plate 18. Plate 18 is perforated by a plurality of holes (not shown) so that the holes form air chambers when plates 14, 16 and 18 are in contact with one another. Plates 14, 16 and 18 are hermetically sealed at their peripheries to form baffle 12.

Disposed within housing 10 is a cylindrical inner sleeve constituting a waveguide 22. First and second seals 24 and 26 attach waveguide 22 to baffle 12 and to the end of housing 10 opposite baffle 12, respectively. Housing 10, baffle 12, waveguide 22 and seals 24, 26 together form an air space 28. Preferably, seals 24 and 26 are 0-ring seals.

Located within waveguide 22 is a piezoelectric ceramic tube 30 which is supported and isolated from waveguide 22 and baffle 12 by an encapsulant 32 composed of a density controlled material such as polyurethane. Electrical leads 34 and 36 are provided to connect piezoelectric ceramic tube 30 to external circuitry (not shown) for either supplying an electrical stimulus to piezoelectric ceramic tube 30 or for receiving from the piezoelectric ceramic tube 30 an electrical signal produced by sound waves entering transducer 1 and mechanically stressing the piezoelectric ceramic tube 30 as a function of those sound waves.

The operation of the transducer 1 will be described in terms of transmitting a signal that is applied to the piezoelectric ceramic tube 30 through electrical leads 34 and 36. An electrical signal, applied to piezoelectric ceramic tube 30, causes tube 30 to vibrate in the radial direction, thereby producing pressure pulsations, i.e., sound waves. These pressure pulsations are propagated through encapsulant 32 in a radial direction until the pressure pulsations contact waveguide 22. Waveguide 22 redirects the reflected pressure pulsations along the axis of transducer 1.

Reflection of the pressure pulsations at the interface between encapsulant 32 and waveguide 22/air space 28 is described by Snell's law, which states that $(\cos \theta_i)/c_i$ is a constant, where $\theta_i$ is the angle between the direction of propagation and the horizontal plane of the interface, and $c_i$ is the sound velocity. A special case occurs at a boundary where the speed of refracted sound is less than the speed of reflected sound, such as is the case at an air/water interface. This causes total internal reflection of the pressure pulsations. The difference between the respective speeds of sound produces an acoustic impedance mismatch between the two mediums.

A fraction of the reflected pressure pulsations are directed towards baffle 12 while a fraction are transmitted forward, away from baffle 12. Those reflected pressure pulsations which encounter baffle 12 are reflected forward along the axis of transducer 1 in essentially the same manner as those pressure pulsations encountering waveguide 22.

The pressure pulsations propagated in the forward direction are not appreciably reflected at the interface of encapsulant 32 with sea water because of the properties of the material used for encapsulant 32. The density of the material is controlled during fabrication of transducer 1 so that the acoustic impedance of the material is matched to the acoustic impedance of the sea water at the intended operating depth, and, therefore, no acoustic impedance mismatch occurs. Thus, the pressure pulsations are propagated across the boundary with no appreciable loss or reflection back into the transducer 1. A transducer, built as described above and as shown in the FIGURE, provided a front-to-back ratio of 10–12 decibels (db) at the design frequency range of 10–16 kilohertz (kHz) during operational testing.

The materials used in constructing the transducer 1 are selected for corrosion resistance to sea water and for the strength needed to withstand submergence to the intended operating depth of 3000 meters. Thus, for example, housing 10, waveguide 22 and plates 14, 16 and 18 forming baffle 12 advantageously made from stainless steel or titanium. Aluminum or other materials can be used for less stringent depth requirements. Piezoelectric ceramic tube 30 advantageously is formed of Navy Type I, Navy Type III or other similar piezoelectric materials that will produce the necessary radial motion. In addition, third plate 18 forming baffle 12 may advantageously be formed from expanded metal or similar materials.

Other modifications and variations to the invention will be apparent to those skilled in the art from the foregoing disclosure and teachings. Thus, while only certain embodiments of the invention have been specifically described herein, is will be apparent that numerous modifications may be made thereto without departing from the spirit and scope of the invention.

What is claimed is:

1. An underwater acoustic waveguide transducer comprising:

a reflecting baffle;

an outer housing disposed substantially perpendicular to said baffle and operatively connected at a first end to said baffle;

a waveguide disposed within and separated from said housing;

sealing means for forming a closed air space between said outer housing and said waveguide; and a radially vibratable piezoelectric ceramic tube disposed within and isolated from said waveguide.

2. The transducer of claim 1 wherein said housing is made from a material selected from the group consisting of stainless steel and titanium.

3. The transducer of claim 1, wherein said waveguide is stainless steel.

4. The transducer of claim 1, wherein said piezoelectric ceramic tube is supported and isolated from said baffle and said waveguide by an encapsulant.

5. The transducer of claim 4 wherein said encapsulant is polyurethane.

6. The transducer of claim 5 wherein said encapsulant is acoustically matched to sea water at the operating depth of said transducer.

7. The transducer of claim 1, wherein said baffle comprises:

first and second plates disposed substantially parallel to each other and an intermediate third plate defining air chambers, said first, second and third plates being sealed at their respective peripheries to form a hermetically sealed baffle.

8. The transducer of claim 7, wherein said third plate is expanded metal.

9. The transducer of claim 7, wherein said third plate is formed with a plurality of holes.

10. The transducer of claim 7, wherein said first and second plates are made from a material selected from the group consisting of stainless steel or titanium.

11. The transducer of claim 1, wherein said sealing means comprises first and second sealing means for forming a closed air space, said first and second sealing means operatively connecting a first end of said waveguide to said baffle and a second end of said waveguide to said outer housing, respectively.

12. A deep submergence, acoustically stable directional underwater acoustic waveguide transducer comprising:

a reflecting baffle having first and second plates disposed substantially parallel to each other and an intermediate third thin plate, said first, second and third plates being sealed at their respective peripheries to form a hermetically sealed baffle;

an outer housing disposed substantially perpendicular to said baffle and operatively connected at a first end to said baffle;

a waveguide disposed within said housing and operatively connected at a first end to said baffle and operatively connected at a second end to a second end of said housing to form a closed air space; and a radially vibratable piezoelectric ceramic tube disposed within said waveguide and isolated from said baffle and said waveguide by an polyurethane encapsulant acoustically matched to sea water at the operating depth of said transducer.

13. The transducer of claim 12 wherein said housing is made from a material selected from the group consisting of stainless steel and titanium.

14. The transducer of claim 12, wherein said waveguide is stainless steel.

15. The transducer of claim 12, wherein said third plate is expanded metal.

16. The transducer of claim 12, wherein said third plate is formed with a plurality of holes.

17. The transducer of claim 12, wherein said first and second plates are made from a material selected from the group consisting of stainless steel or titanium.

* * * * *